US005680430A

United States Patent [19]

Khutoryansky et al.

[11] Patent Number: 5,680,430

[45] Date of Patent: Oct. 21, 1997

[54] METHOD AND APPARATUS FOR CONTROLLING AND OPTIMIZING OUTPUT OF AN X-RAY SOURCE

[75] Inventors: Oscar Khutoryansky, Glenview; Thomas Rosevear, Forest Park; Thomas Simak, Warrenville; Cyril Tomsic, Hanover Park, all of Ill.

[73] Assignee: Continental X-Ray Corporation, Broadview, Ill.

[21] Appl. No.: 636,565

[22] Filed: Apr. 23, 1996

[51] Int. Cl.[6] ..... H05G 1/34

[52] U.S. Cl. ..... 378/109; 378/110; 378/11

[58] Field of Search ..... 378/146, 145, 378/151, 150, 109, 110, 111, 112, 11, 16, 19

[56] References Cited

U.S. PATENT DOCUMENTS

| | | | |
|---|---|---|---|
| 5,228,070 | 7/1993 | Mattson | 378/146 |
| 5,485,494 | 1/1996 | Williams et al. | 378/145 |

*Primary Examiner*—Don Wong

*Attorney, Agent, or Firm*—Laff, Whitesel, Conte, & Saret, Ltd.

[57] ABSTRACT

A method for controlling output of an x-ray source to optimize x-ray energy arriving at an associated x-ray receptor during linear tomographic examination. The method comprises the steps of selecting tomographic sweep parameters, predicting a set of x-ray source control parameters based, at least in part, upon the selected tomographic sweep parameters, and controlling x-ray source output in accordance with the set of x-ray source control parameters to optimize x-ray energy arriving at the associated x-ray receptor. Apparatus for controlling output of an x-ray source is also disclosed.

18 Claims, 6 Drawing Sheets

METHOD AND APPARATUS FOR CONTROLLING AND OPTIMIZING OUTPUT OF AN X-RAY SOURCE

FIELD OF THE INVENTION

This invention relates generally to automatic exposure control for an x-ray system and in particular to an x-ray system in which the relative positions of the x-ray source and the x-ray receptor vary during examination, and is more particularly directed toward a method and apparatus for optimizing x-ray source output during linear tomographic examination.

BACKGROUND OF THE INVENTION

Linear tomography is a well-known technique for obtaining a relatively clear image of a thin slice of an object under examination, while "blurring out" potentially obstructing tissue above and below the area of interest. An effective tomographic examination requires a predetermined sweep angle for the relative motions of the x-ray source and x-ray receptor. The smoothness of the relative motions and the alignment of the source and receptor are very important factors in obtaining a high quality diagnostic image. Ideally, the exposure at each tomographic angle (view) should contribute an equal amount of radiation flux to the accumulated resultant image.

A linear tomographic exposure is usually done on the basis of a fixed time for the exposure. Each of the tomographic sweep angles has one or more associated values of exposure time. The duration of the exposure is constant for the selected exam. Using current methods, the operator must estimate the appropriate technique for the desired film density of each particular examination. Parameters other than exposure time, such as kVp (kilovolts peak) and mA (milliamperes), become variable factors, used by the operator to achieve the optimum exposure technique and the best diagnostic quality of the image. As is well-known in the x-ray art, kVp is one expression of the voltage supplied to an x-ray tube by an x-ray generator control. The x-ray dose received at the receptor varies exponentially with kVp, although the precise relationship depends to some degree upon beam hardening. Another measure of x-ray tube output is mA, referring to the current supplied to the x-ray tube. The output of the x-ray tube can be expressed as the product of x-ray tube current and exposure time by using mAs, or milliampere-seconds.

Thus, one problem that needs to be addressed is the selection of kVp and mA to achieve a diagnostic image of the best possible quality. The operator usually selects kVp and/or mA based on experience and reference book guidance. Another problem that must be addressed is that the prediction of the optimum technique for a tomographic examination is complex, because a number of variable parameters must be considered, such as the source to receptor distance, angular velocity, the angle at which x-ray photons strike the film, and the object thickness.

In linear tomography, the change in source-image distance (SID) is compensated by angular velocity changes throughout the sweep. But variation in the thickness of the object or patient being examined exists, as does variation in the angle at which the x-ray hits the film. The effects of thickness variation and changes in the incident angle at which x-ray photons impact the film result in angular views contributing less radiation flux to the tomographic image than views taken along the normal SID line (0° angulation).

At least one attempt has been made to design an automatic exposure control system, or AEC, for linear tomography. In U.S. Pat. No. 5,432,833, for a mechanical tomographic system, a linear reference ramp is provided for comparison with an integral signal produced by an ionization chamber to determine an error signal and so control the output power of an x-ray source.

However, the attempt to correct the dose variation by providing the linear reference ramp and comparing it with the actual feedback signal from the ionization chamber requires substantial change in the corrected parameter and results in a delay in the response of the feedback loop.

Accordingly, a need arises for a method for controlling output of an x-ray source that does not rely strictly upon feedback control, that is relatively easy to implement using reliable components, and that does not add inordinately to the expense of a tomographic system. The method should address both the need to select values of kVp and mA for optimum diagnostic image quality, and the variable parameters, such as the angle at which x-ray photons strike the film, and the object thickness, that must be considered in prediction of the optimum technique for a tomographic examination.

SUMMARY OF THE INVENTION

These needs and others are satisfied by the present invention, in which a method for controlling output of an x-ray source to optimize x-ray energy arriving at an associated x-ray receptor during linear tomographic examination is described. The method comprises the steps of selecting tomographic sweep parameters, predicting a set of x-ray source control parameters based, at least in part, upon the selected tomographic sweep parameters, and controlling x-ray source output in accordance with the set of x-ray source control parameters to optimize x-ray energy arriving at the associated x-ray receptor. The step of selecting tomographic sweep parameters further includes the steps of selecting tomographic sweep angle, and selecting tomographic sweep time.

The step of predicting a set of x-ray source control parameters further includes the steps of determining a tomographic examination profile based, at least in part, upon the selected tomographic sweep parameters and desired optical density at the x-ray receptor, and determining a power correction profile based, at least in part, upon the tomographic examination profile, wherein the power correction profile includes a set of x-ray generator control parameters associated with a selected set of SID angles, where the SID angle is the angle between the source-receptor SID line and a line normal to the x-ray receptor. The x-ray generator control parameters may include kVp and mA.

The step of determining a power correction profile further includes the steps of determining initial x-ray generator control parameters for an initial x-ray source position for a tomographic sweep, predicting effects of variation in SID angle on x-ray energy arriving at the x-ray receptor, and determining the x-ray generator control parameters for subsequent x-ray source positions in accordance with the predicted effects.

The step of predicting effects of variation in patient thickness comprises predicting the effects of variation in x-ray quanta based upon the relationship:

$$N=N_o*e^{-\mu d[(1/\cos\theta)-1]},$$

where

N is quanta (radiation flux) penetrating material under examination;

$N_o$ is number of incident quanta;

μ is linear attenuation coefficient; and d is initial thickness of the material.

According to another aspect of the invention, the step of controlling x-ray source output in accordance with the set of x-ray source control parameters comprises the steps of determining current x-ray source position, and applying to the x-ray source the set of x-ray source control parameters associated with the current x-ray source position. The step of applying to the x-ray source the set of x-ray source control parameters associated with the current x-ray source position comprises controlling x-ray source output power in accordance with the x-ray source control parameters.

In another form of the invention, a method is disclosed for controlling output of an x-ray source to optimize x-ray energy arriving at an associated x-ray receptor during linear tomographic examination, the method comprising the steps of providing an x-ray source positioned on a first side of an object to be examined, providing an x-ray energy detector positioned on an opposite side of the object to be examined, selecting tomographic sweep parameters, predicting a set of x-ray source control parameters based, at least in part, upon the selected tomographic sweep parameters, controlling x-ray source output in accordance with the set of x-ray source control parameters, approximating, by means of the x-ray energy detector, x-ray energy arriving at the associated x-ray receptor, and adjusting x-ray source output in response to the approximated x-ray energy to optimize x-ray energy arriving at the associated x-ray receptor.

In yet another form of the invention, an apparatus is described for controlling output of an x-ray source to optimize x-ray energy arriving at an associated x-ray receptor during linear tomographic examination. The apparatus comprises means for selecting tomographic sweep parameters, means for predicting a set of x-ray source control parameters based, at least in part, upon the selected tomographic sweep parameters, and means for controlling x-ray source output in accordance with the set of x-ray source control parameters to optimize x-ray energy arriving at the associated x-ray receptor.

The means for selecting tomographic sweep parameters comprises a tomographic control panel through which tomographic sweep angle and tomographic sweep time are selected. The means for predicting a set of x-ray source control parameters comprises a microprocessor and associated memory in which a table of x-ray source control parameters is constructed based upon a tomographic examination profile and a power correction profile. The tomographic examination profile is based, at least in part, upon the selected tomographic sweep parameters and desired optical density at the x-ray receptor.

The power correction profile includes a set of x-ray generator control parameters associated with a selected set of SID angles, where the SID angle is the angle between the source-receptor SID line and a line normal to the x-ray receptor. The means for controlling x-ray source output comprises means for determining current x-ray source position, and means for applying to the x-ray source the set of x-ray source control parameters associated with the current x-ray source position.

In still another form of the invention, an apparatus is disclosed for controlling output of an x-ray source to optimize x-ray energy arriving at an associated x-ray receptor during linear tomographic examination. The apparatus comprises means for emitting x-rays positioned on a first side of an object to be examined, means for detecting x-ray energy positioned on an opposite side of the object to be examined, means for selecting tomographic sweep parameters, means for predicting a set of x-ray source control parameters based, at least in part, upon the selected tomographic sweep parameters, means for controlling x-ray source output in accordance with the set of x-ray source control parameters, means for approximating x-ray energy arriving at the associated x-ray receptor, and means for adjusting x-ray source output in response to the approximated x-ray energy to optimize x-ray energy arriving at the associated x-ray receptor. The means for emitting x-rays comprises an x-ray tube, and the means for detecting x-ray energy may comprise an ionization chamber.

In another aspect of the invention, yet another method is presented for controlling output of an x-ray source to optimize x-ray energy arriving at an associated x-ray receptor during linear tomographic examination. The method comprises the steps of selecting kVp for the x-ray source to provide a selected kVp, conducting a preliminary radiographic exposure terminated by automatic exposure control, recording mAs from the preliminary radiographic exposure to provide post mAs, selecting tomographic sweep parameters, determining required mA for the tomographic examination based, at least in part, upon selected kVp and post mAs, applying the required mA to the x-ray source, and conducting the tomographic examination.

In accordance with yet another aspect of the invention, a method is introduced for controlling output of an x-ray source to optimize x-ray energy arriving at an associated x-ray receptor during linear tomographic examination. The method comprises the steps of conducting a preliminary radiographic exposure terminated by automatic exposure control, recording mAs from the preliminary radiographic exposure to provide post mAs, selecting tomographic sweep parameters, predicting a set of x-ray source control parameters based, at least in part, upon the selected tomographic sweep parameters, and controlling x-ray source output in accordance with the set of x-ray source control parameters and post mAs to optimize x-ray energy arriving at the associated x-ray receptor.

In yet a further aspect of the invention an apparatus for controlling output of an x-ray source to optimize x-ray energy arriving at an associated x-ray receptor during linear tomographic examination comprises means for conducting a preliminary radiographic exposure, means for recording mAs from the preliminary radiographic exposure to provide post mAs, means for selecting tomographic sweep parameters, means for predicting a set of x-ray source control parameters based, at least in part, upon the selected tomographic sweep parameters, and means for controlling x-ray source output in accordance with the set of x-ray source control parameters and post mAs to optimize x-ray energy arriving at the associated x-ray receptor.

Further objects, features, and advantages of the present invention will become apparent from the following description and drawings.

DETAILED DESCRIPTION OF THE INVENTION

In accordance with the present invention, a method and apparatus for controlling and optimizing output of an x-ray source are described that provide distinct advantages when compared to those of the prior art. The invention can best be understood with reference to the accompanying drawing figures.

Figure 1:
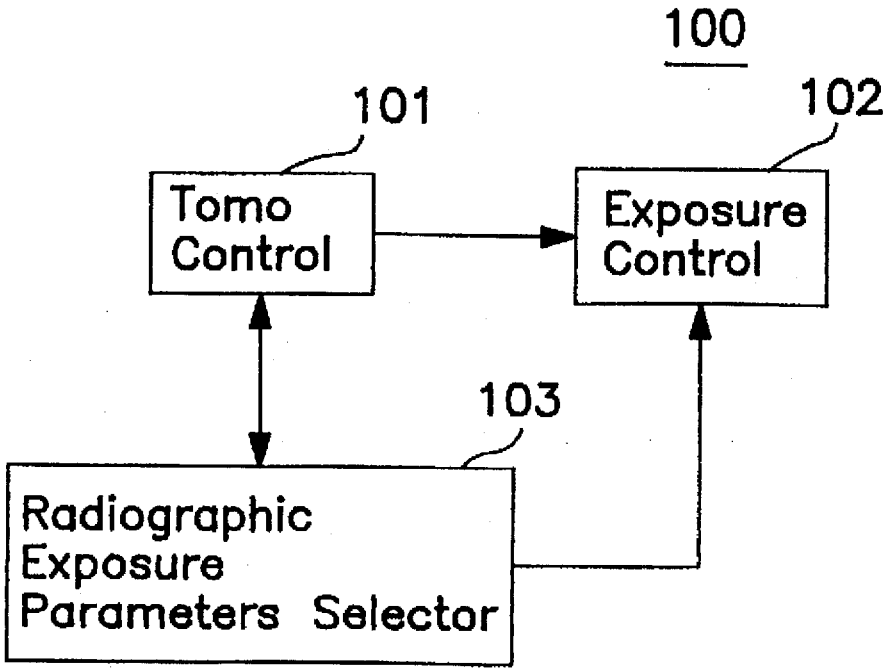
FIG. 1 (Prior Art)
FIG. 1 is a block diagram illustrating linear tomography control without automatic exposure control.

FIG. 1 illustrates a linear tomography system, generally depicted by the numeral 100, without automatic exposure control. The system includes a radiographic exposure parameters selector 103, or x-ray generator control, that allows the user to preselect the technique that will be used to control x-ray source output. The user may typically elect to control and monitor kVp, mA, or both.

The linear tomography system also includes a tomography control unit 101, or tomo control, that allows the user to select the parameters that are normally associated with a particular tomographic technique. These parameters include tomographic sweep angle and tomographic sweep time. The tomographic sweep time can generally be equated to the total exposure time.

An exposure control module 102 combines the inputs of the radiographic exposure parameters selector 103 and the tomo control 101 to control the tomographic sweep/exposure.

This completely "open-loop" approach to tomography system control is generally unsatisfactory, since it ignores variation in x-ray radiation reaching the receptor during the course of the tomographic examination. The quantity of applied radiation that actually reaches the receptor during linear tomography depends upon a number of factors.

First, with angulation, the thickness of the slice to be penetrated increases. Due to the thickness variation, the penetrating radiation flux changes during the tomographic sweep according to the following law of attenuation:

$$N=N_o*e^{-\mu d[(1/\cos\theta)-1]},$$

where:

N is quanta (radiation flux) penetrating the material, $N_o$ is the number of incident quanta, μ is the linear attenuation coefficient of the object or patient undergoing tomographic examination (0.4 for the human body), and d is the initial thickness of the object.

Performing the calculation for μ=0.4 and d=10 inches reveals that for a 40° sweep, quanta penetration varies up to 30% from ±20° to 0°. This variation in applied dose due to variation in quanta penetration will be termed $\Delta D_1$.

Also with angularion, the x-ray flux density is decreased by a factor of cos θ in accordance with the following:

$$\Delta D_2=f\Delta\cos\theta,$$

where:

$\Delta D_2$ is the variation in applied dose, due to the variation in the flux density, and f is the initial flux density.

For a 40° tomographic sweep (±20°), the variation in applied dose will be +7%.

The combined dose variation in a linear tomography exam is then given by:

$$\Delta D=\Delta D_1+\Delta D_2$$

For a 40° sweep (±20°), the combined variation in applied dose can be as high as +37%.

As shown above, in tomographic motion the dose changes non-linearly during the tomo sweep. But it is possible to predict the dose variation and compensate for it through the use of an appropriate model that takes into account the dose variation factors noted above.

Figure 2:
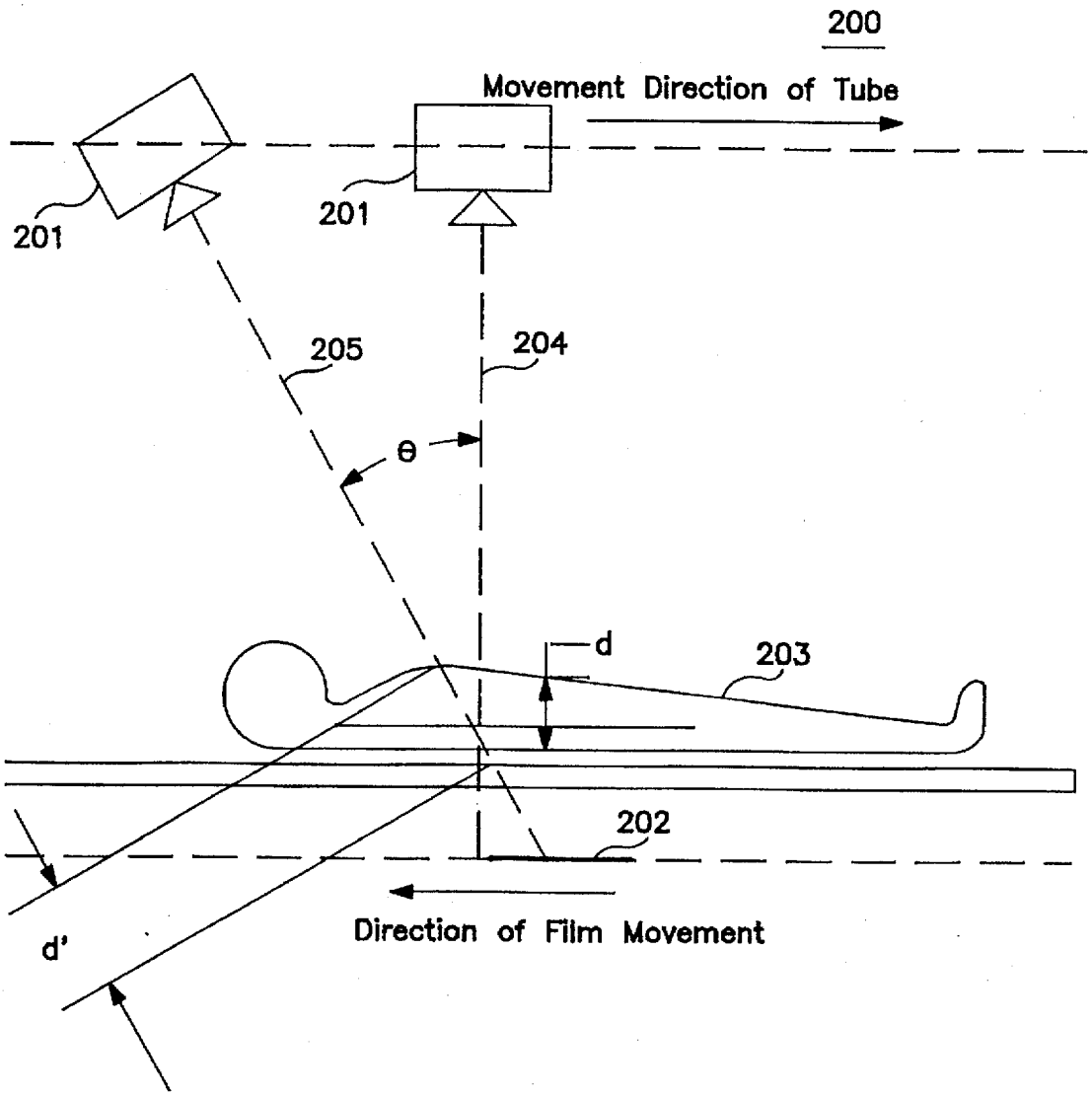
FIG. 2 is a stylized depiction of a linear tomographic apparatus for examination of a human patient.

FIG. 2 illustrates, through a stylized depiction of a tomographic examination apparatus 200, many of the parameters introduced above. In executing a tomographic sweep for examination of a human subject 203, an x-ray tube 201 moves in a first indicated direction, while an x-ray receptor, such as an x-ray film 202, moves in the opposite direction.

The line 205 joining the x-ray source 201 and the receptor 202 is termed the source-receptor SID line, and the angle θ is the angle between the source-receptor SID line 205 and the line 204 that is normal to the receptor 202. The initial thickness d of the patient 203 is measured along the line 204 that is normal to the receptor 202.

The instantaneous thickness d', measured along the source-receptor SID line 205, is the thickness that the x-ray beam must actually traverse, at any instant of time, during the course of a tomographic sweep. The instantaneous thickness d' varies with the angle θ, as does the distance from source 201 to receptor 202 measured along the source-receptor SID line 205.

Figure 3:
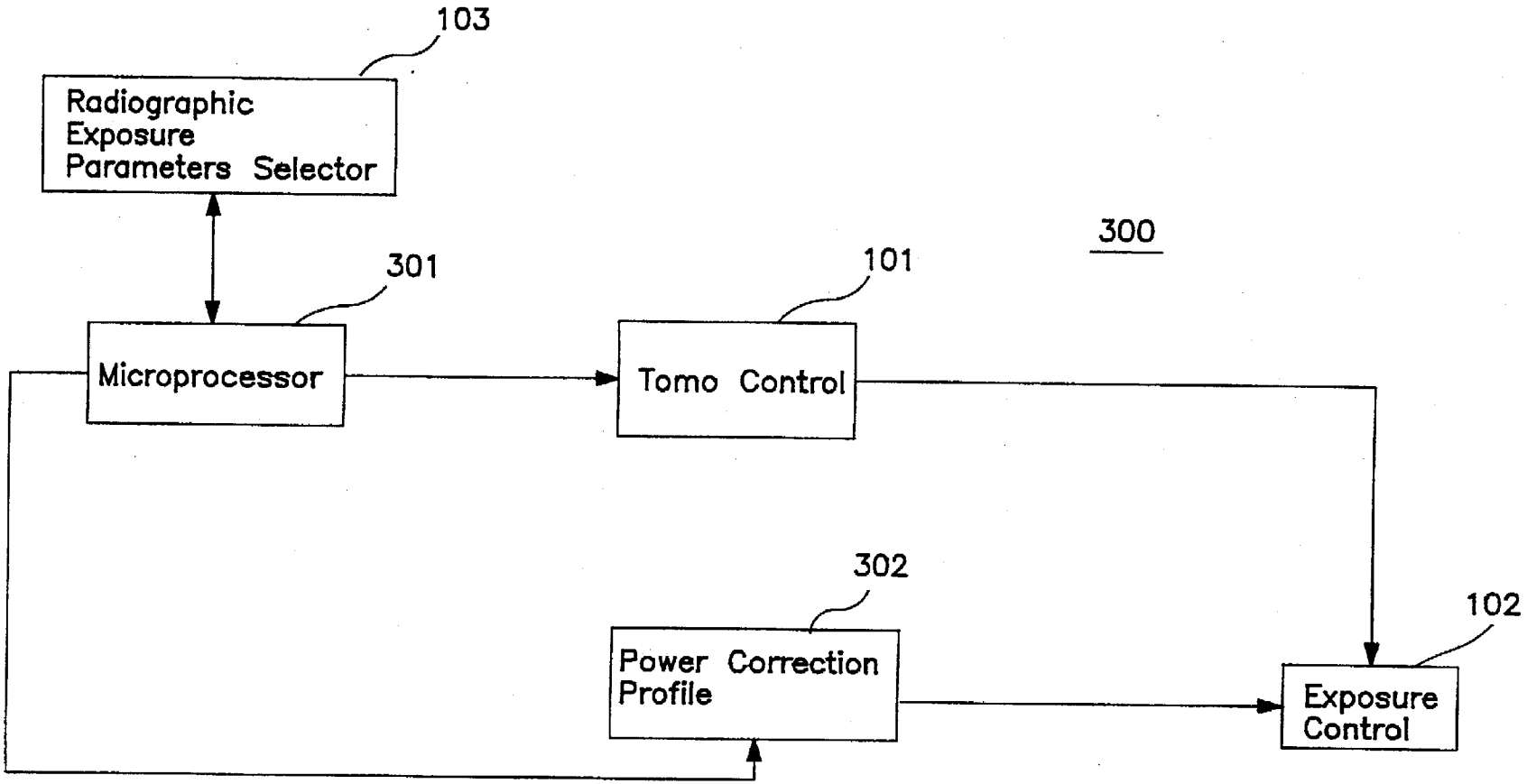
FIG. 3 is a block diagram of a linear tomography system incorporating predictive power control.

FIG. 3 is a block diagram of a linear tomography system, generally depicted by the numeral 300, incorporating the capability to predict and compensate for dose variation. The system 300 includes a tomo control unit 101, exposure control 102, and radiographic exposure parameters selector 103 that are identical to those discussed with reference to FIG. 1. Therefore, these system components will not be discussed in detail here.

The predictive control system 300 incorporates a microprocessor 301 that predicts a set of x-ray source control parameters based, at least in part, upon operator selected tomographic sweep parameters. These x-ray source control parameters are stored in an associated memory as a power correction profile 302.

The power correction profile 302 is the overall sweep of the x-ray source during tomographic examination broken down into a number of SID angles. The SID angle is the angle between the SID line joining the source and image, and a line normal to the x-ray receptor. For each one of these SID angles, x-ray source control parameters, in the form of kVp or mAs values (or both) are stored as x-ray source control parameters that form the power correction profile 302.

Since the SID angle is easily computed by the microprocessor using position information signals available from the system control components, the microprocessor detects the SID angle and adjusts the x-ray source output in accordance with the power correction profile 302. In arriving at the power correction profile, the microprocessor 301 utilizes information about the tomographic examination program, that could be termed a tomographic examination profile. This tomographic examination profile is based upon the tomographic sweep parameters (sweep angle and sweep time), initial source-image distance, and desired optical density at the x-ray receptor.

Using the relationships discussed above for finding the variation in x-ray dose corresponding to changes in SID, angularion (or SID angle), and angular velocity, the microprocessor 301 predicts the amount by which x-ray source power must be adjusted, up or down, for a set of selected SID angles.

Figure 4:
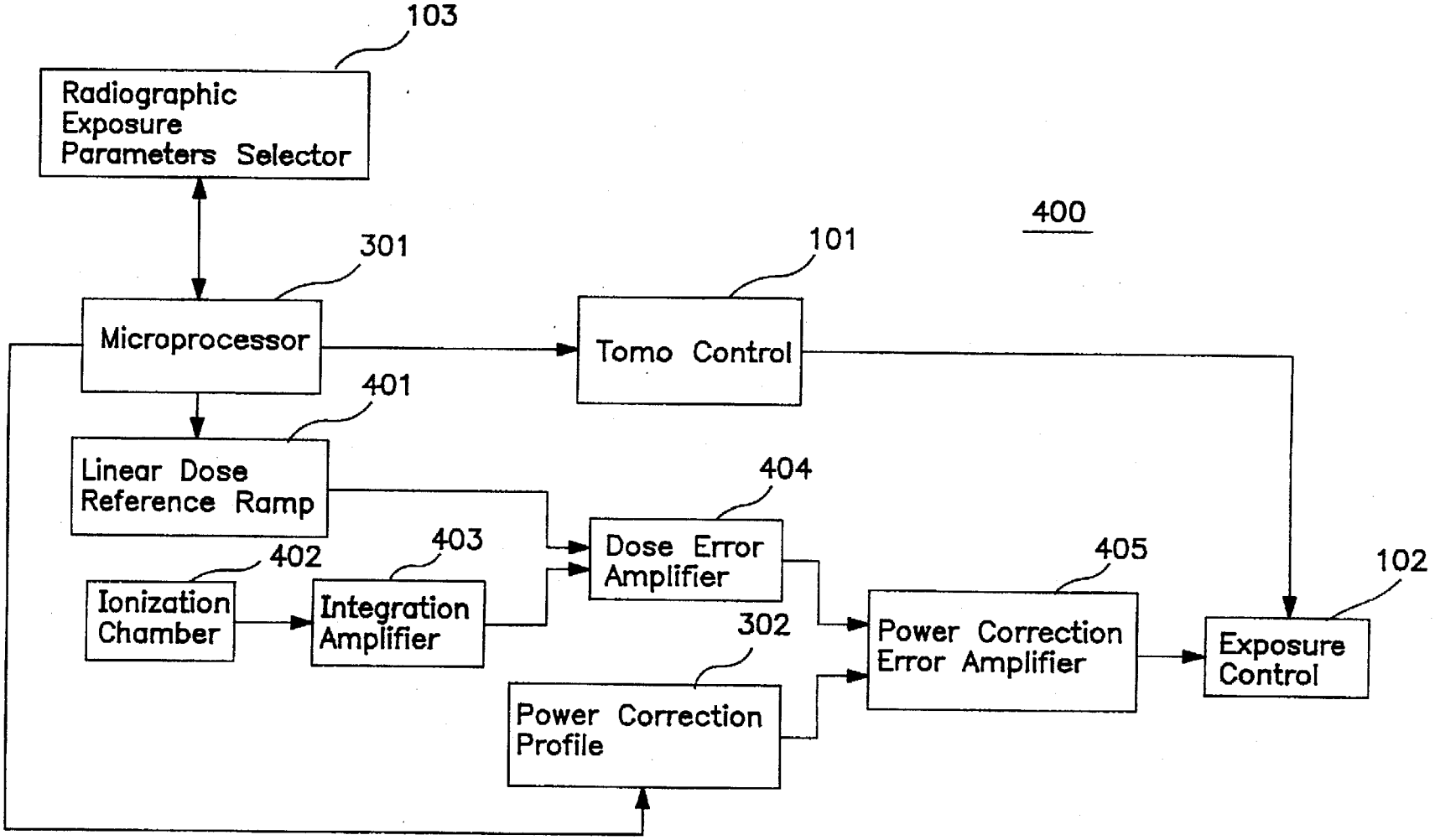
FIG. 4 is a block diagram of a linear tomography system using a combination of predictive control and dose error feedback control.

FIG. 4 illustrates, in block diagram form, a linear tomography control system, generally depicted by the numeral 400, that incorporates both predictive control and feedback control over x-ray source output. The control system 400 incorporates the predictive control system illustrated in FIG. 3, so these common components will not be discussed again with reference to FIG. 4.

An x-ray energy detector 402, such as an ionization chamber, is positioned on the side of the object to be imaged that is away from the x-ray source. In fact, the x-ray energy detector is preferably positioned above the x-ray receptor. The output of the ionization chamber is coupled to an integration amplifier. Since the output of the ionization chamber is an ionization current, an integration amplifier 403 converts this ionization current signal into a voltage ramp that is input to a dose error amplifier 404.

The microprocessor, based upon the tomographic examination profile discussed above, creates a linear dose reference ramp 401 that approximates the ideal integrated dose for the entire tomographic examination exposure. The actual dose information from the ionization chamber 402 and the ideal dose data from the microprocessor 301 are compared in a dose error amplifier 404, that generates an error signal.

Control of the x-ray source output is initially under the control of the microprocessor-generated power correction profile 302, as discussed above. The addition of the dose error amplifier 404 allows the power correction error amplifier 405 to correct any errors in the power correction profile 302 in real time, by virtue of a correction signal output from the power correction error amplifier 405, thus resulting in more accurate control of the x-ray source output power. Since the control system 400 does not rely solely upon feedback control, the error output of the dose error amplifier will always be small, and system response time will remain rapid.

Figure 5A:
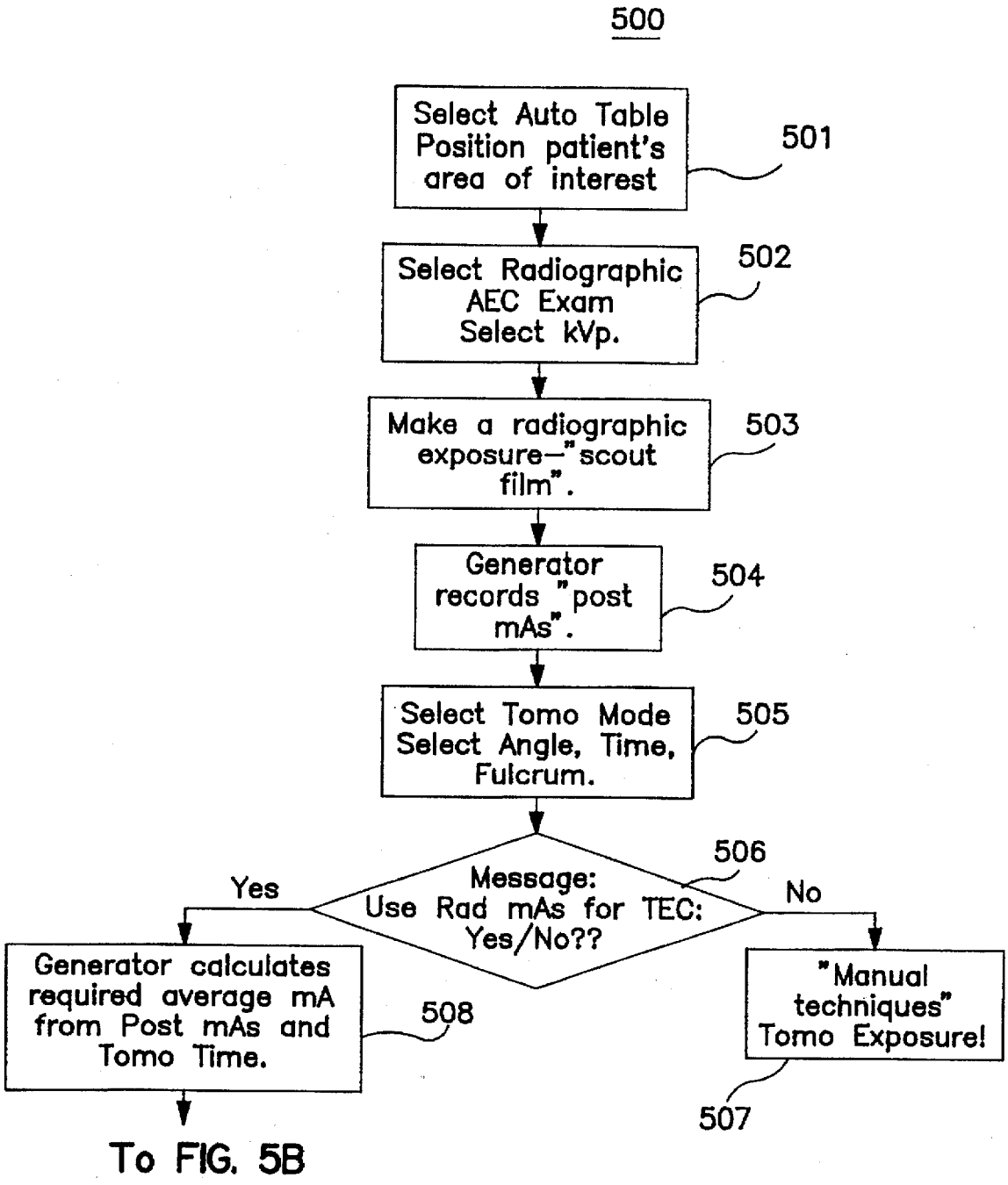
FIG. 5 is a flow chart illustrating an alternative method for selecting tomographic exposure.
Figure 5B:
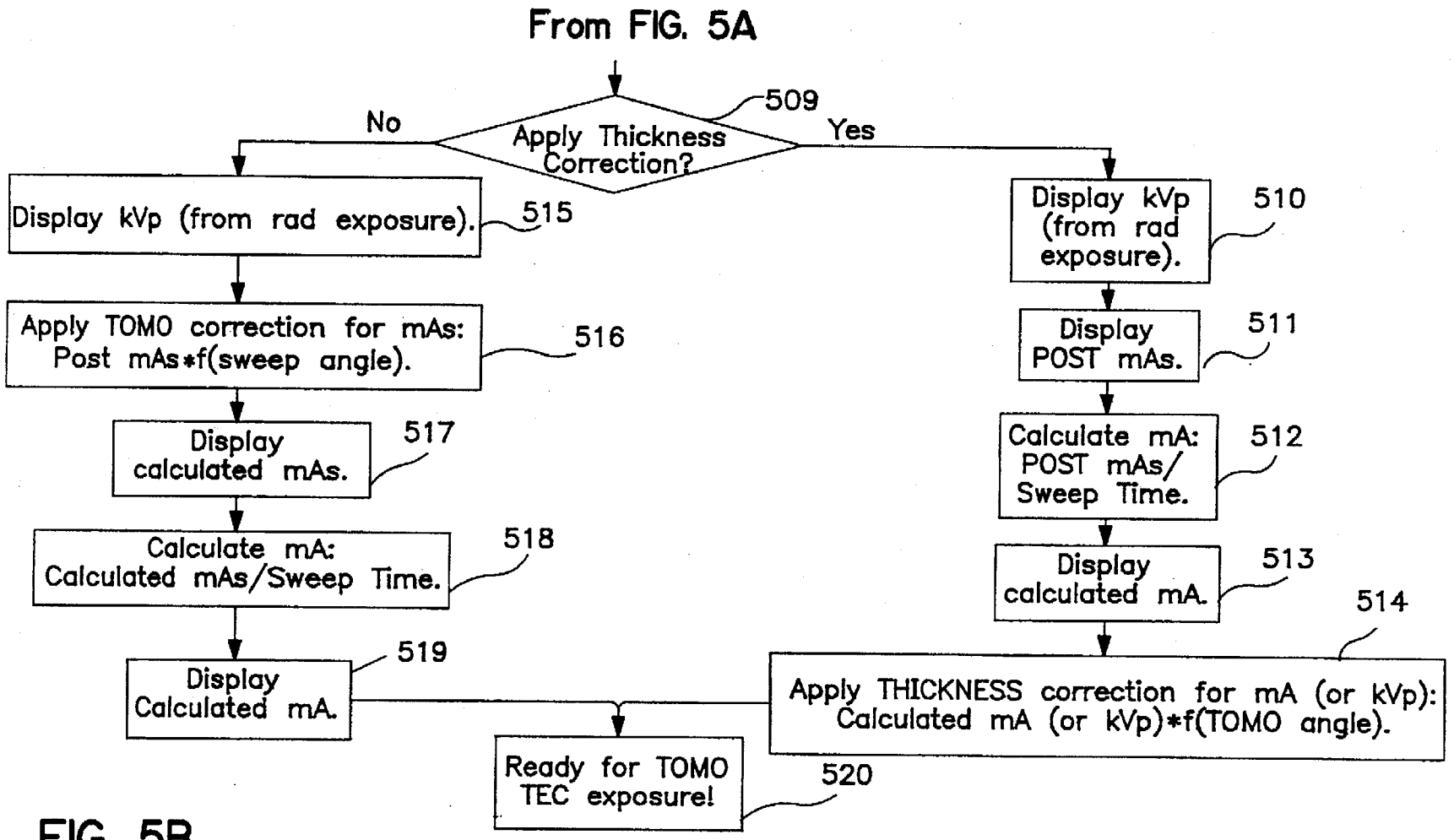

FIG. 5 is a flow chart, generally depicted by the numeral 500, of an alternative method for controlling x-ray source output. First, in step 501, Auto Table Mode is selected for the x-ray apparatus in which a constant 40 inch SID is maintained regardless of table elevation adjustment. Prior to conducting a tomographic examination, the patient 203 (FIG. 2) and the diagnostic apparatus are positioned so that the patient's primary area of interest is located directly between the x-ray source and receptor.

In the next step 502, conventional radiographic examination with automatic exposure control (AEC) is selected on an associated control panel, and the operator enters a value for kVp. A preliminary radiographic exposure, or scout film, is then made in step 503. The scout film is made to verify the area of interest and the alignment of the x-ray source and receptor. This exposure is terminated by AEC. A radiographic scout film is a normal procedure for verifying area of interest and patient position, but the information obtained thereby is not utilized in any way in subsequent tomographic procedures in accordance with prior art techniques.

Within the control system of the generator, such as in the microprocessor 301 and associated memory discussed above, exposure parameters from the preliminary exposure are then recorded (Step 504). One convenient way of accomplishing this is to record mAs for the preliminary exposure, since mAs is a representation of x-ray tube output in terms of the product of x-ray tube current and exposure time. The mAs from the preliminary exposure, or scout film, is termed "post mAs," since this quantity is known only after the scout film has been exposed.

In the next step 505, the operator selects tomographic mode on the system control console, then proceeds to select tomographic sweep angle, sweep time, and fulcrum. In the following step 506, the system asks the operator, by way of a displayed message, whether the Operator would like to use the radiographic mAs from the preliminary radiographic exposure (scout film) for tomographic exposure control (TEC). If not, the operator simply initiates a manual tomographic exposure control mode 507, in which the operator must enter x-ray generator control parameters, such as kVp and mAs, before tomographic examination can begin. Of course, the tomographic examination could proceed under one of the predictive techniques described above.

In the alternative, the operator may answer "yes" to the question of using radiographic mAs. If the operator responds with a "yes," the x-ray generator controller calculates the required mA based upon post mAs and the tomographic sweep time parameter (step 508). In the next step (509), the operator is asked whether thickness correction should be applied.

If the operator responds affirmatively, the kVp value from the preliminary radiographic exposure is displayed in step 510, and the post mAs value is displayed (step 511). In the next operation 512, the mA value is calculated by dividing post mAs by the selected tomographic sweep time, then, in step 513, the calculated mA value is displayed. In the next step 514, the thickness correction is applied for mA (or kVp) by predicting the necessary change in mA (or kVp) for optimum exposure as a function of tomographic angle, as described in detail above. The system is then ready for tomographic TEC exposure (step 520).

Should the operator respond in the negative to the question of applying thickness correction in step 509, the kVp value from the preliminary radiographic exposure is displayed (step 515). In the next operation 516, tomographic compensation is applied to the mAs value by scaling the post mAs by a fixed amount that is determined by the total tomographic sweep angle. In the subsequent step, 517, this calculated mAs value is displayed.

In step 518, a value for mA is calculated by dividing the previously calculated mAs value by the tomographic sweep time, and this calculated mA value is displayed in step 519. The system is then ready for tomographic TEC exposure (step 520) with tomo compensation.

There have been described herein a method and apparatus for controlling and optimizing output of an x-ray source that are relatively free from the shortcomings of the prior art. It will be apparent to those skilled in the art that modifications may be made without departing from the spirit and scope of the invention. Accordingly, it is not intended that the invention be limited except as may be necessary in view of the appended claims.

What is claimed is:

1. A method for controlling output of an x-ray source to optimize x-ray energy arriving at an associated x-ray receptor during linear tomographic examination, the x-ray source and x-ray receptor varying in geometry with respect to one another during said linear tomographic examination, the method comprising the steps of:

(a) selecting linear tomographic sweep parameters;

(b) predicting a set of x-ray source control parameters based, at least in part, upon the selected linear tomographic sweep parameters; and (c) controlling x-ray source output in accordance with the set of x-ray source control parameters to optimize x-ray energy arriving at the associated x-ray receptor.

2. The method in accordance with claim 1, wherein the step of selecting linear tomographic sweep parameters further includes the steps of:

(a) selecting tomographic sweep angle; and (b) selecting tomographic sweep time.

3. The method in accordance with claim 1, wherein the step of predicting a set of x-ray source control parameters further includes the steps of:

(a) determining a linear tomographic examination profile based, at least in part, upon the selected linear tomographic sweep parameters, initial source-image distance, and desired optical density at the x-ray receptor; and (b) determining a power correction profile based, at least in part, upon the linear tomographic examination profile, wherein the power correction profile includes a set of x-ray generator control parameters associated with a selected set of SID angles, where the SID angle is the angle between the source-receptor SID line and a line normal to the x-ray receptor.

4. The method in accordance with claim 3, wherein the x-ray generator control parameters include kVp and mA.

5. The method in accordance with claim 3, wherein the step of determining a power correction profile further includes the steps of:

(a) determining initial x-ray generator control parameters for an initial x-ray source position for a linear tomographic sweep;

(b) predicting effects of variation in thickness of an object to be examined on x-ray energy arriving at the x-ray receptor; and (c) determining the x-ray generator control parameters for subsequent x-ray source positions in accordance with the predicted effects.

6. The method in accordance with claim 1, wherein the step of controlling x-ray source output in accordance with the set of x-ray source control parameters comprises the steps of:

(a) determining current x-ray source position; and (b) applying to the x-ray source the set of x-ray source control parameters associated with the current x-ray source position.

7. The method in accordance with claim 6, wherein the step of applying to the x-ray source the set of x-ray source control parameters associated with the current x-ray source position comprises controlling x-ray source output power in accordance with the x-ray source control parameters.

8. A method for controlling output of an x-ray source to optimize x-ray energy arriving at an associated x-ray receptor during linear tomographic examination, the method comprising the steps of:

(a) selecting tomographic sweep parameters;

(b) predicting a set of x-ray source control parameters based, at least in part, upon the selected tomographic sweep parameters; and (c) controlling x-ray source output in accordance with the set of x-ray source control parameters to optimize x-ray energy arriving at the associated x-ray receptor;

wherein said step (b) of predicting a set of x-ray source control parameters further includes the steps of:

(b1) determining a tomographic examination profile based, at least in part, upon the selected tomographic sweep parameters, initial source-image distance, and desired optical density at the x-ray receptor; and (b2) determining a power correction profile based, at least in part, upon the tomographic examination profile, wherein the power correction profile includes a set of x-ray generator control parameters associated with a selected set of SID angles, where the SID angle is the angle between the source-receptor SID line and a line normal to the x-ray receptor;

wherein said step (b2) of determining a power correction profile further includes the steps of:

(b2a) determining initial x-ray generator control parameters for an initial x-ray source position for a tomographic sweep;

(b2b) predicting effects of variation in thickness of an object to be examined on x-ray energy arriving at the x-ray receptor; and (b2c) determining the x-ray generator control parameters for subsequent x-ray source positions in accordance with the predicted effects; and wherein the step (b2b) of predicting effects of variation in thickness of an object to be examined comprises predicting the effects of variation in x-ray quanta based upon the relationship:

$$N=N_o*e^{-\mu d[(1/\cos\theta)-1]},$$

where:

N is quanta (radiation flux) penetrating material under examination;

$N_o$ is number of incident quanta;

μ is linear attenuation coefficient; and d is initial thickness of the material.

9. A method for controlling output of an x-ray source to optimize x-ray energy arriving at an associated x-ray receptor during linear tomographic examination, the x-ray source and x-ray receptor varying in geometry with respect to one another during said linear tomographic examination, the method comprising the steps of:

(a) providing an x-ray source positioned on a first side of an object to be examined;

(b) providing an x-ray energy detector positioned on an opposite side of the object to be examined;

(c) selecting linear tomographic sweep parameters;

(d) predicting a set of x-ray source control parameters based, at least in part, upon the selected linear tomographic sweep parameters;

(e) controlling x-ray source output in accordance with the set of x-ray source control parameters;

(f) approximating, by means of the x-ray energy detector, x-ray energy arriving at the associated x-ray receptor; and (g) adjusting x-ray source output in response to the approximated x-ray energy to optimize x-ray energy arriving at the associated x-ray receptor.

10. Apparatus for controlling output of an x-ray source to optimize x-ray energy arriving at an associated x-ray receptor during linear tomographic examination, the x-ray source and x-ray receptor varying in geometry with respect to one another during said linear tomographic examination, the apparatus comprising:

means for selecting linear tomographic sweep parameters;

means for predicting a set of x-ray source control parameters based, at least in part, upon the selected linear tomographic sweep parameters; and means for controlling x-ray source output in accordance with the set of x-ray source control parameters to optimize x- ray energy arriving at the associated x-ray receptor.

11. The apparatus of claim 10, wherein the means for selecting linear tomographic sweep parameters comprises a tomographic control panel through which tomographic sweep angle and tomographic sweep time are selected.

12. The apparatus of claim 10, wherein the means for predicting a set of x-ray source control parameters comprises a microprocessor and associated memory in which a table of x-ray source control parameters is constructed based upon a linear tomographic examination profile and a power correction profile.

13. The apparatus of claim 12, wherein the power correction profile includes a set of x-ray generator control parameters associated with a selected set of SID angles, where the SID angle is the angle between the source-receptor SID line and a line normal to the x-ray receptor.

14. The apparatus of claim 10, wherein the means for controlling x-ray source output comprises:

means for determining current x-ray source position; and means for applying to the x-ray source the set of x-ray source control parameters associated with the current x-ray source position.

15. Apparatus for controlling output of an x-ray source to optimize x-ray energy arriving at an associated x-ray receptor during linear tomographic examination, the x-ray source and x-ray receptor varying in geometry with respect to one another during said linear tomographic examination, the apparatus comprising:

means for emitting x-rays positioned on a first side of an object to be examined;

means for detecting x-ray energy positioned on an opposite side of the object to be examined;

means for selecting linear tomographic sweep parameters;

means for predicting a set of x-ray source control parameters based, at least in part, upon the selected linear tomographic sweep parameters;

means for controlling x-ray source output in accordance with the set of x-ray source control parameters;

means for approximating x-ray energy arriving at the associated x-ray receptor; and means for adjusting x-ray source output in response to the approximated x-ray energy to optimize x-ray energy arriving at the associated x-ray receptor.

16. A method for controlling output of an x-ray source to optimize x-ray energy arriving at an associated x-ray receptor during linear tomographic examination, the x-ray source and x-ray receptor varying in geometry with respect to one another during said linear tomographic examination, the method comprising the steps of:

(a) selecting kVp for the x-ray source to provide a selected kVp;

(b) conducting a preliminary radiographic exposure terminated by automatic exposure control;

(c) recording mAs from the preliminary radiographic exposure to provide post mAs;

(d) selecting linear tomographic sweep parameters;

(e) determining required mA for the linear tomographic examination based, at least in part, upon selected kVp and post mAs;

(f) applying the required mA to the x-ray source; and (g) conducting the linear tomographic examination.

17. A method for controlling output of an x-ray source to optimize x-ray energy arriving at an associated x-ray receptor during linear tomographic examination, the x-ray source and x-ray receptor varying in geometry with respect to one another during said linear tomographic examination, the method comprising the steps of:

(a) conducting a preliminary radiographic exposure terminated by automatic exposure control;

(b) recording mAs from the preliminary radiographic exposure to provide post mAs;

(c) selecting linear tomographic sweep parameters;

(d) predicting a set of x-ray source control parameters based, at least in part, upon the selected linear tomographic sweep parameters; and (e) controlling x-ray source output in accordance with the set of x-ray source control parameters and post mAs to optimize x-ray energy arriving at the associated x-ray receptor.

18. Apparatus for controlling output of an x-ray source to optimize x-ray energy arriving at an associated x-ray receptor during linear tomographic examination, the x-ray source and x-ray receptor varying in geometry with respect to one another during said linear tomographic examination, the apparatus comprising:

means for conducting a preliminary radiographic exposure;

means for recording mAs from the preliminary radiographic exposure to provide post mAs;

means for selecting linear tomographic sweep parameters;

means for predicting a set of x-ray source control parameters based, at least in part, upon the selected linear tomographic sweep parameters; and means for controlling x-ray source output in accordance with the set of x-ray source control parameters and post mAs to optimize x-ray energy arriving at the associated x-ray receptor.

* * * * *